US006454595B1

(12) United States Patent
Espenshade

(10) Patent No.: US 6,454,595 B1
(45) Date of Patent: Sep. 24, 2002

(54) MODULAR JACK WITH LED

(75) Inventor: Len Espenshade, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/931,068

(22) Filed: Aug. 15, 2001

(51) Int. Cl.[7] ..... H01R 3/00
(52) U.S. Cl. ..... 439/490
(58) Field of Search ..... 439/488–490, 439/676, 910, 701

(56) References Cited

U.S. PATENT DOCUMENTS 4,978,317 A * 12/1990 Pocrass ..... 439/490
5,685,737 A * 11/1997 Morin et al. ..... 439/490
5,700,157 A * 12/1997 Chung ..... 439/490
5,704,802 A * 1/1998 Loudermilk ..... 439/490
5,915,993 A * 6/1999 Belopolsky et al. ..... 439/490
5,957,730 A * 9/1999 Wang ..... 439/490
6,142,822 A * 11/2000 Wu ..... 439/490
6,174,194 B1 * 1/2001 Bleicher et al. ..... 439/490
6,283,786 B1 * 9/2001 Margulis et al. ..... 439/490

* cited by examiner

*Primary Examiner*—Gary P. Paumen
(74) *Attorney, Agent, or Firm*—Wei Te Chung

(57) ABSTRACT

A modular jack (1) comprises a housing (2), a terminal module (3), and an LED assembly (4). The housing comprises a top wall (22), a bottom wall (23), and a pair of sidewalls (21) neighboring to the top and bottom walls. The walls define a receiving channel (25) for receiving a complementary connector. The top wall comprises a pair of slots (220) and a pair of hooks (221) extending upwardly into the slots. The terminal module is placed in the receiving channel, and comprises a mounting base (30) and a plurality of terminals (31) mounted on the mounting base. The LED assembly comprises a base (40) and a pair of LEDs (41) retained on the base. The LEDs are received in the slots of the housing. The base comprises a pair of mating faces (42) for engaging with the hooks to retain the LEDs in the slots.

1 Claim, 5 Drawing Sheets

MODULAR JACK WITH LED

BACKGROUND OF THE INVENTION

1. Field of the Invention

The present invention relates to a modular jack, and particularly to a modular jack which retains an LED (Light-Emitting Diode) therein 2. Description of Related Art A modular jack, also known as an RJ connector, is commonly used in network and computer peripheral equipment system for the transmission of voice and data. An RJ connector is typically used to form a link between two pieces of equipment to provide a communication therebetween. In order to ensure the integrity of the link, it has been a practice in the industry to use an LED located separately from the link to provide visual status and fault information regarding the connection. RJ cannectors having such LEDs are disclosed in U.S. Pat. Nos. 4,978,317, 5,685,737 and 5,704,802, wherein an LED always is in an "L" shape and comprises a horizontal stabilizer and a vertical retainer both of which are inserted into corresponding channels defined in the connector. However, the LED is not provided with an alignment or stabilization means to ensure the LED to be steadily or safely retained in the RJ connector.

An improved modular jack with secured LEDs is required to overcome the disadvantages of the related art.

SUMMARY OF THE INVENTION

Accordingly, the object of the present invention is to provide a modular jack with a built-in LED assembly securely assembled in a housing of the modular jack and on a printed circuit board.

In order to achieve the object set forth, a modular jack comprises an insulative housing, a terminal module, and an LED assembly. The housing comprises a top wall, a bottom wall, and a pair of sidewalls neighboring to the top and bottom walls. The walls define a receiving channel for receiving a complementary plug connector. The top wall comprises a pair of slots near adjacent sidewalls and a pair of hooks extending upwardly into the slots. The terminal module is placed in the receiving channel and comprises a mounting base and a plurality of terminals mounted on the mounting base. The LED assembly is mounted on the housing, and comprises a base and a pair of LEDs mounted on the base. The LEDs are received in the slots of the housing. The base defines a pair of mating faces for engaging with a corresponding hook to securely retain the LEDs in the slots Other objects, advantages and novel features of the invention will become more apparent from the following detailed description when aken in conjunction with the accompanying drawings.

DETAILED DESCRIPTION OF THE INVENTION

Figure 1:
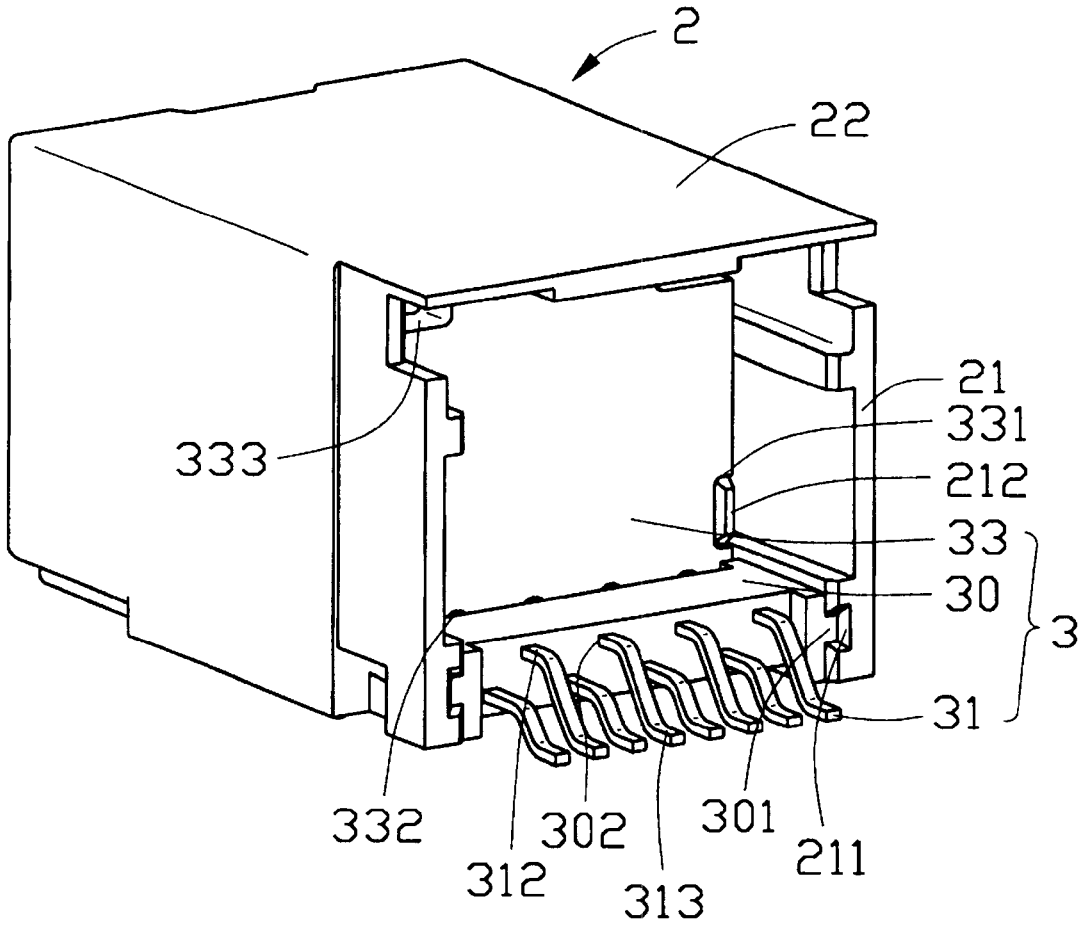
FIG. 1 is a perspective view of an insulative housing of a modular jack of the present invention with a terminal module received therein.

Reference will now be made to the drawing figures to describe the present invention in detail.

Referring to FIGS. 1–4, a modular jack 1 in accordance with the present invention comprises an insulative housing 2, a terminal module 3 received in the housing 2 for mating with contacts of a complementary plug connector (not shown), an LED assembly 4 received in the housing 2, and a conductive shield 5 enclosing the insulative housing 2 for grounding.

Figure 2:
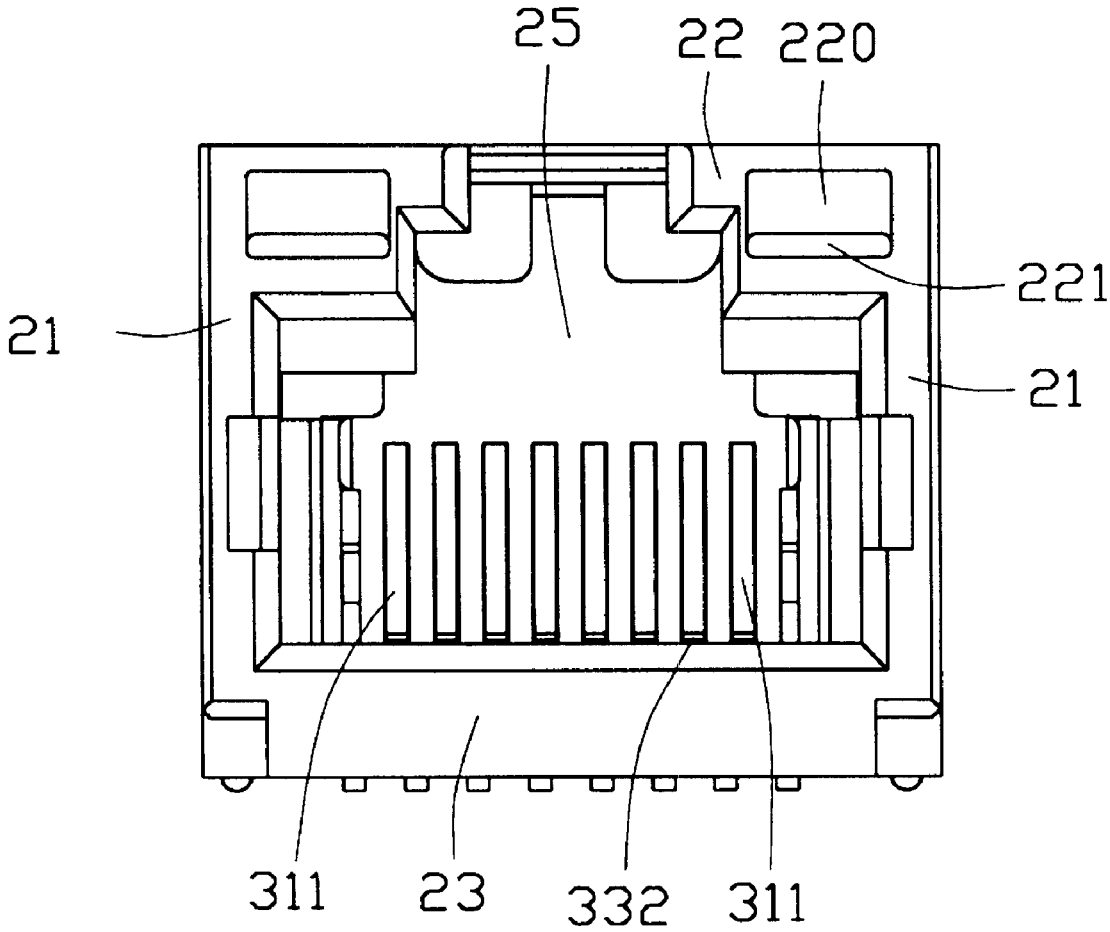
FIG. 2 is a front view of FIG. 1.

As is shown in FIGS. 1–2, the insulative housing 2 includes a top wall 22, a bottom wall 23, and a pair of sidewalls 21 neighboring to the top and bottom walls 22, 23. The top wall 22, bottom Mall 23 and sidewalls 21 together define a receiving channel 25 therebetween for receiving the complementary plug connector and the terminal module 3 therein. The top wall 22 defines a pair of slots 220 at front edge thereof near an adjacent sidewall 21 and a pair of hooks 221 extending upwardly into the slots 220. Each sidewall 21 defines a groove 211 at a lower end thereof and also forms a projection 212.

The terminal module 3 comprises a base 30, a rectangular retention board 33 and a plurality of terminals 31. The base 30 comprises a pair of flanges 301 at opposite transverse edges thereof, and a plurality of through holes 302. The retention board 33 comprises a pair of notches 331 at opposite transverse edges thereof for receiving the projection 212 of the housing 2, a pair of openings 333 at a top edge thereof for insertion of the LEDs 41, and a plurality of holes 332 for receiving corresponding terminals 31. Each terminal 31 comprises a mounting portion 312 mounted in corresponding through hole 302 of the base 30 and corresponding hole 332 of the retention board 3, a contacting portion 311 extending forwardly from the mounting portion 312 into the receiving channel 25 of the housing 2 for electrically contacting with the plug connector, and a tail portion 313 extending rearwardly from the mounting portion 312 for electrical connecting with a printed circuit board on which the modular jack 1 is mounted (not shown).

Figure 3:
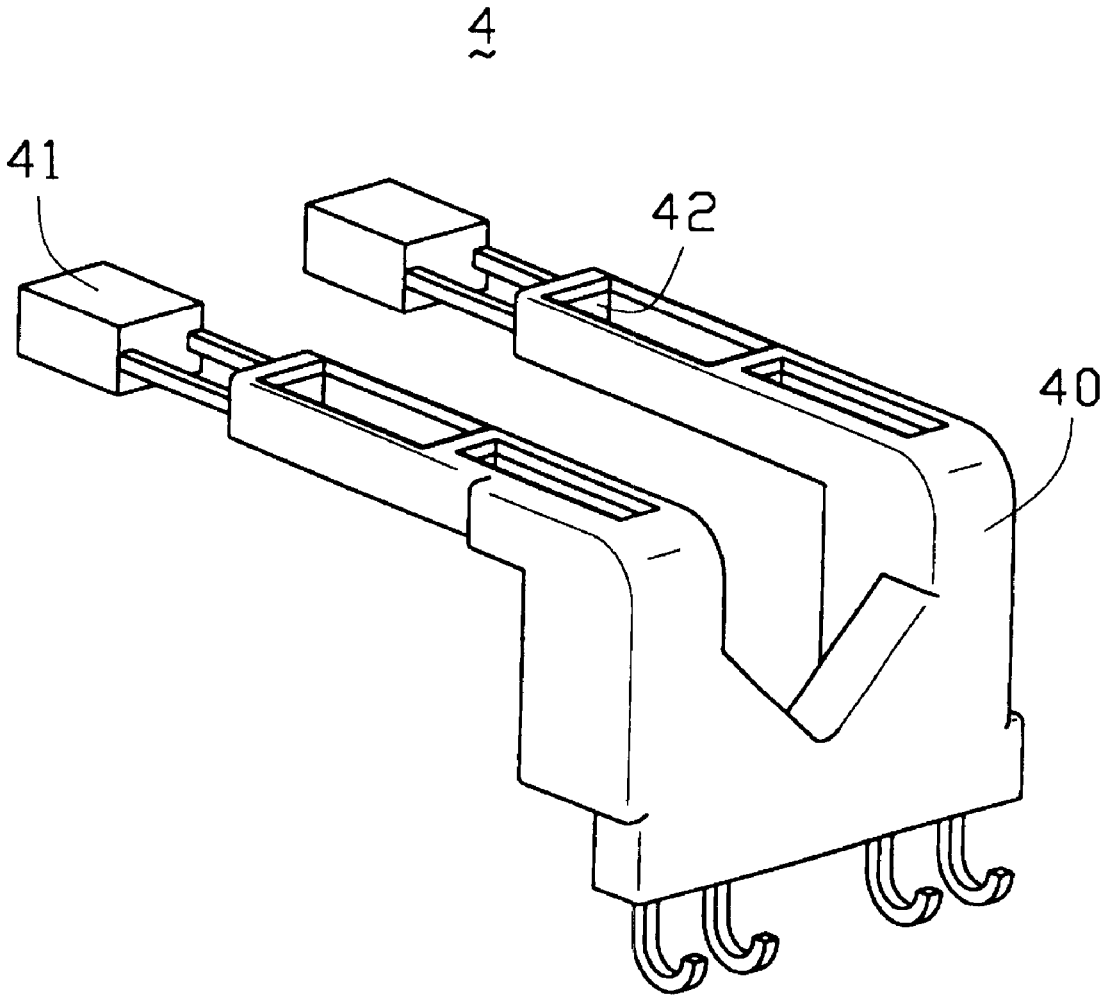
FIG. 3 is a perspective view of an LED assembly of the modular jack of the present invention.

Referring to FIG. 3, the LED assembly 4 comprises a base 40 and a pair of LEDs 41 assembled on the base 40. The base 40 comprises a pair of mating faces 42 opposite to the LEDs 41 to engaging with a corresponding hook 221 of the housing 2.

Figure 4:
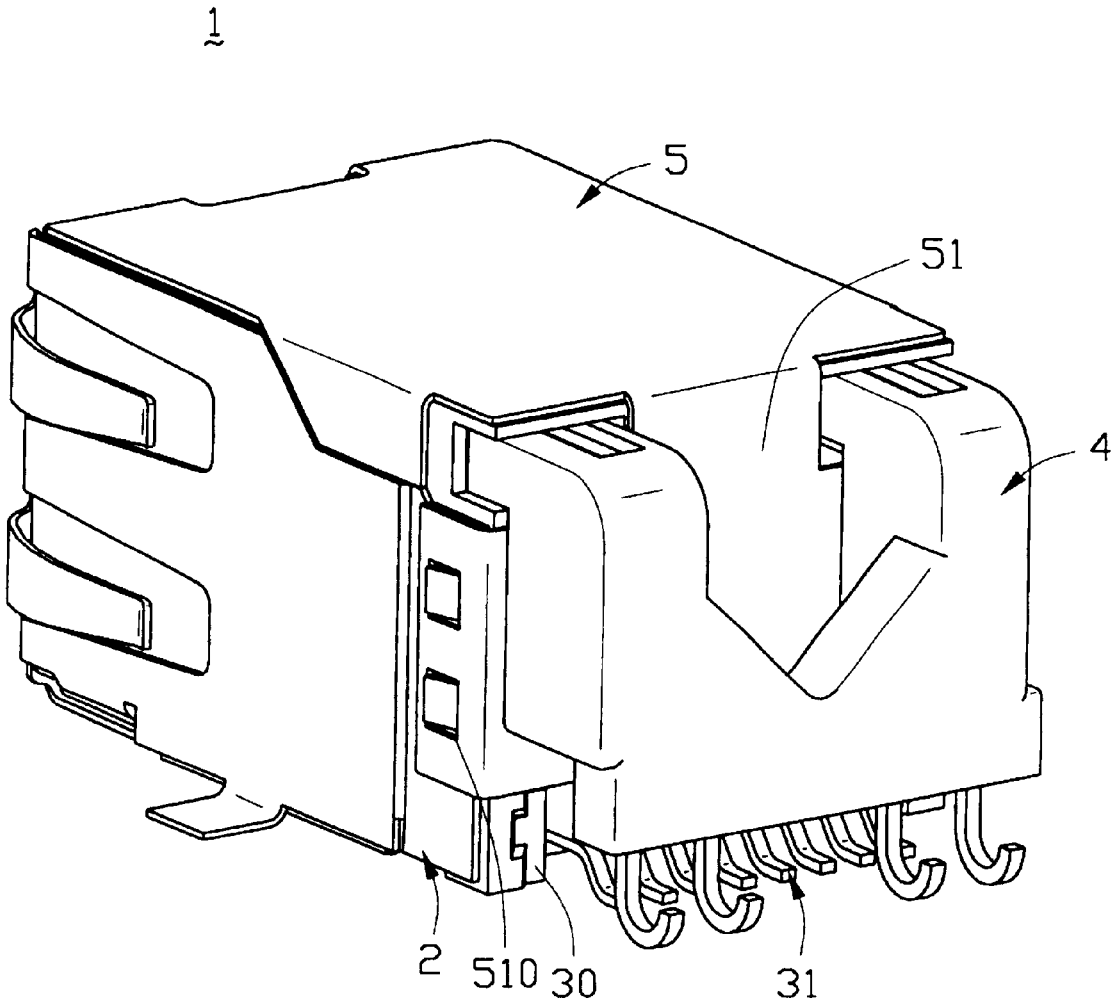
FIG. 4 is a perspective view of the assembled modular jack.
Figure 5:
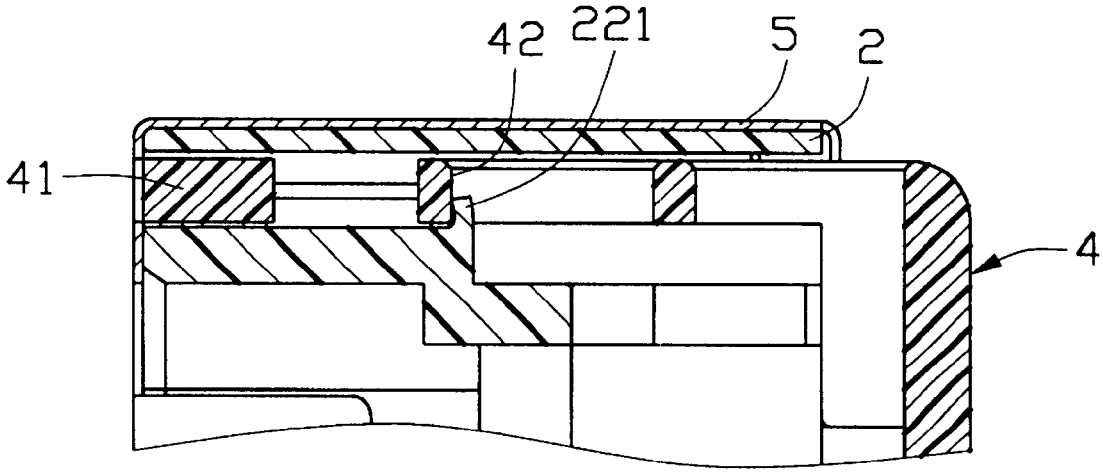
FIG. 5 is a fragmentary, cross-sectional view of FIG. 4 showing a hook being engaged with an LED.

Referring to FIGS. 4–5, in assembly, the terminal module 3 is assembled in the receiving channel 25 of the housing 2 from the rear with the projections 212 of the housing 2 received in the notches 331 of the retention board 33 and with the flanges 301 of the base 30 received in the grooves 211 of the housing 2. Subsequently, the shidd 5 encloses the housing 2 with a rear portion 51 thereof being bent downwardly and with openings 510 of the rear portion 51 engaging with latches 500 of opposite side portions 50 to securely retain the shield 5 on the housing 2 The LED assembly 4 is mounted on the housing 2 with the LEDs 41 being inserted into the slots 220 of the top wall 22 through the openings 333 of the retention board 33. The hooks 221 engage with a corresponding mating face 42 to prevent the LED assembly 4 from moving rearwardly, thereby securely assembling the LED assembly 4 to the housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack, comprising:

an insulative housing comprising a top wall, a bottom wall, and a pair of sidewalls, the top wall, the bottom wall and the sidewalls together defining a receiving channel, the top wall defining a slot near one of the two sidewalls and a hook extending into the slot;

a terminal module received in the receiving channel of the insulative housing and comprising a mounting base and a plurality of terminals mounted on the mounting base; and an LED assembly being mounted on the housing, and comprising a base and an LED retained on the base, the LED being received in the slot of the housing, the base defining a mating face for engaging with the hook to securely retain the LED in the slot;

wherein the terminal module further comprises a retention board for securely mounting the terminals in the receiving channel of the housing;

wherein the retention board defines a plurality of holes for retaining corresponding terminals therein and an opening for allowing insertion of the LED into the slot of the housing;

wherein the retention board defines a notch at each of two transverse edges thereof, and each sidewall of the insulative housing comprises a projection engaging with the notch for securely retaining the retention board in the channel;

wherein each terminal comprises a mounting portion mounted in the mounting base of the terminal module, a contacting portion extending forwardly from the mounting portion into the channel, and a tail portion extending rearwardly from the mounting portion;

wherein the mounting base of the terminal module comprises a pair of outwardly extending flanges, and wherein each sidewall of the housing defines a groove for receiving a corresponding flange.

* * * * *